US010736392B2

(12) United States Patent
Tan

(10) Patent No.: US 10,736,392 B2
(45) Date of Patent: Aug. 11, 2020

(54) LUGGAGE WITH TRANSVERSE DISPLACEMENT WHEELS

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 179 days.

(21) Appl. No.: 15/943,945

(22) Filed: Apr. 3, 2018

(65) Prior Publication Data

US 2019/0298021 A1 Oct. 3, 2019

(51) Int. Cl.
*A45C 5/14* (2006.01)

(52) U.S. Cl.
CPC ..... *A45C 5/146* (2013.01); *A45C 2005/147* (2013.01)

(58) Field of Classification Search
CPC ..... A45C 5/146; A45C 2005/147
See application file for complete search history.

(56) References Cited

U.S. PATENT DOCUMENTS 2,472,491 A * 6/1949 Bernard ..... A45C 5/146 280/37
4,411,343 A * 10/1983 Cassimally ..... A45C 5/146 16/113.1
4,575,109 A * 3/1986 Cowdery ..... A45C 5/00 190/18 A
5,493,755 A * 2/1996 Kindstrand ..... B60B 33/045 16/44
6,382,736 B1 * 5/2002 Chang ..... A45C 5/14 16/44
6,814,361 B2 * 11/2004 Tsu ..... B62B 5/0083 280/43.1
7,725,986 B2 * 6/2010 Tsai ..... B60B 3/048 16/46
8,936,257 B2 * 1/2015 Kinnee ..... A45C 5/146 16/44
9,033,350 B2 * 5/2015 Porri ..... A45C 5/146 280/37
9,586,442 B2 * 3/2017 Trickle ..... B60B 33/06

* cited by examiner

*Primary Examiner* — Tri M Mai

(57) ABSTRACT

A luggage with transverse displacement wheels includes a luggage body (1) having a giving-away surface (16) located on the junction between the bottom panel (13) and back panel (11) thereof, a transverse displacement wheel (2) mounted to each side panel (15) of the luggage body (1). The transverse displacement wheel (2) includes a wheel holder (21) coupled to one respective side panel (15) near the giving-away surface (16) and a tire (22) pivotally mounted on the wheel holder (21). The wheel holder (21) is transversely slidable relative to the luggage body (1) and lockable to the luggage body (1) in one of a series of positions near or far from the front panel (12) to let a relatively smaller or larger part of the tire (22) protrude over the giving-away surface (16), facilitating storage or moving on stairs of an uneven road surface.

3 Claims, 13 Drawing Sheets

LUGGAGE WITH TRANSVERSE DISPLACEMENT WHEELS

BACKGROUND OF THE INVENTION

1. Field of the Invention

The present invention relates to luggage technology and more particularly, to a luggage with transverse displacement wheels, which allows adjustment of the transverse displacement wheels between two positions relative to the luggage body, facilitating storage or walking on stairs or uneven road surface.

2. Description of the Related Art

At the bottom of the luggage, wheels are installed so that the luggage can be easily pushed or pulled by the user. At the present, most luggage wheels are small diameter wheels to avoid increasing the overall size of the luggage. However, when moving on an uneven road surface (such as cracked or gravel ground), small diameter wheels can get stuck. Further, when carrying a luggage up or down stairs, the user needs to lift the luggage from stairs and to move the luggage by hand.

When a luggage is equipped with large diameter wheels, the luggage can be conveniently moved on an uneven road surface or stairs, however, the overall size of the luggage will increase, and the support point will be close to the inner side of the luggage body, making the luggage easy to fall down and not convenient for storage.

SUMMARY OF THE INVENTION

The present invention has been accomplished under the circumstances in view. It is therefore the main object of the present invention to provide a luggage with transverse displacement wheels, which allows adjustment of the transverse displacement wheels between a first position close to the luggage body and a second position far from the luggage, facilitating storage or walking on stairs or uneven road surface.

To achieve this and other objects of the present invention, a luggage comprises a luggage body and two transverse displacement wheels. The luggage body comprises a back panel, a front panel, a bottom panel, a top panel and two opposing side panels respectively connected to one another, and a giving-away surface located on the junction between the bottom panel and the back panel and inwardly recessed toward the inside of the luggage body. The transverse displacement wheels are respectively mounted to the side panels of the luggage body, each comprising a wheel holder and a tire pivotally mounted on the wheel holder and peripherally protruding over the giving-away surface of the luggage body. The wheel holder is transversely slidably coupled to the luggage body and lockable to the luggage body in one of a series of positions near or far from the front panel to let a relatively smaller or larger part of the tire protrude over the giving-away surface, facilitating storage or moving on stairs of an uneven road surface.

When going to receive the luggage or to carry the luggage on a smooth road surface, shift the wheel holder to the position near the front panel to minimize the part of the tire that protrudes over the giving-away surface. When going to carry the luggage on stairs or an uneven road surface, shift the wheel holder to a position far from the front panel to maximize the part of the tire that protrudes over the giving-away surface.

DETAILED DESCRIPTION OF THE PREFERRED EMBODIMENT

Figure 1:
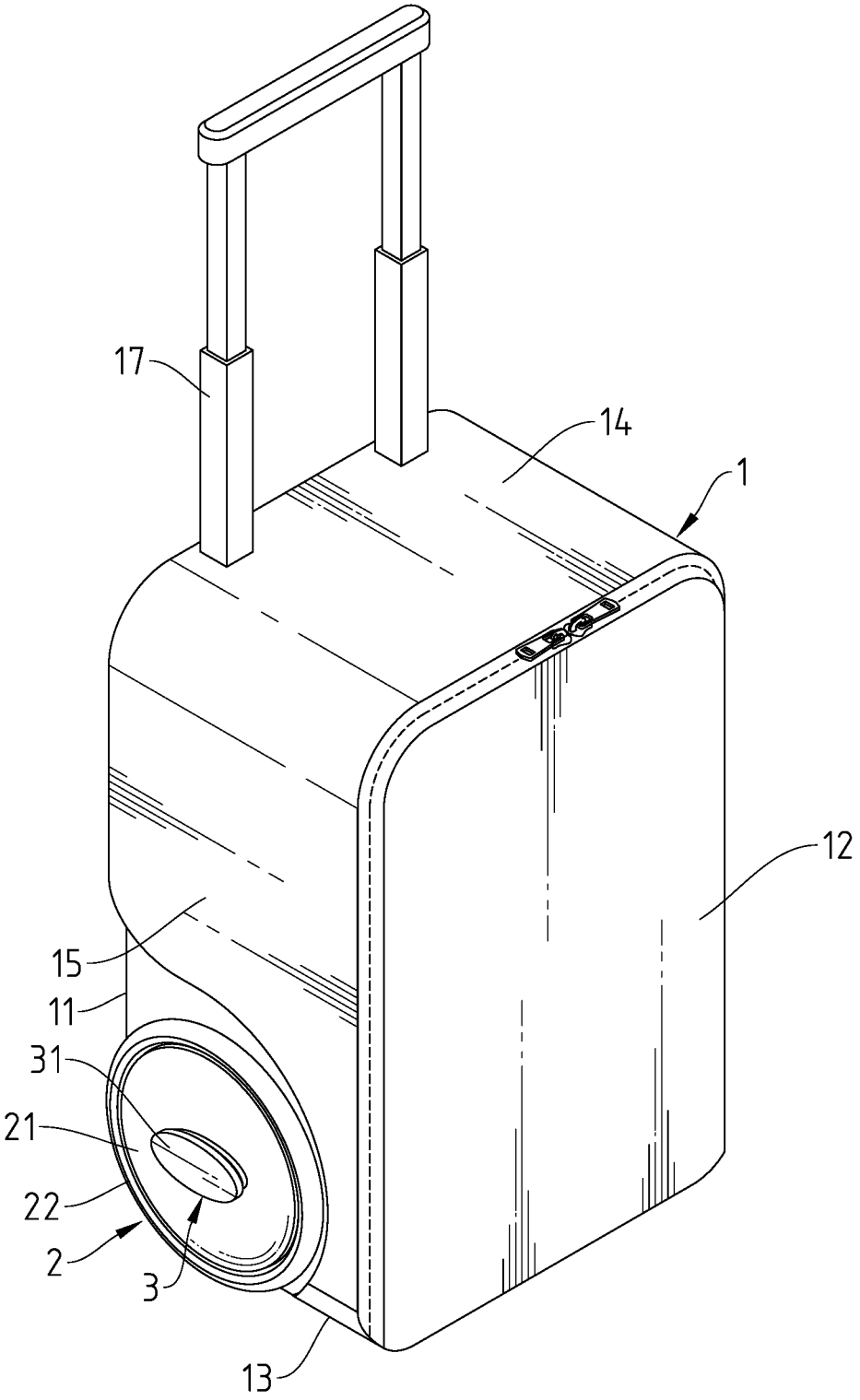
FIG. 1 is an oblique top elevation of a luggage with transverse displacement wheels in accordance with the present invention.

Referring to FIGS. 1-4, a luggage with transverse displacement wheels in accordance with the present invention is shown. The luggage with transverse displacement wheels comprises a luggage body 1, at least one, for example, two transverse displacement wheels 2, and a locking device 3 corresponding to one respective transverse displacement wheel 2.

The luggage body 1 consists of a back panel 11, a front panel 12, a bottom panel 13, a top panel 14 and two opposing side panels 15. Further, the luggage body 1 comprises a giving-away surface 16 located on the junction between the bottom panel 13 and the back panel 11 and inwardly recessed toward the inside of the luggage body 1, and a retractable handle 17 mounted to the back panel 11. In this embodiment, the giving-away surface 16 is circularly arched.

The transverse displacement wheels 2 are respectively mounted to the side panels 15 of the luggage body 1, each comprising a wheel holder 21 and a tire 22 pivotally mounted on the wheel holder 21. The wheel holder 21 is eccentrically pivoted to one respective side panel 15 near the giving-away surface 16, and movable linearly toward or away from the front panel 12. The tire 22 is peripherally exposed to the outside of the giving-away surface 16 of the luggage body 1.

The locking device 3 is mounted in the wheel holder 21 of the respective transverse displacement wheel 2 and adapted for locking the wheel holder 21 to the luggage body 1 in one of a series of positions near or far from the front panel 12.

Figure 2:
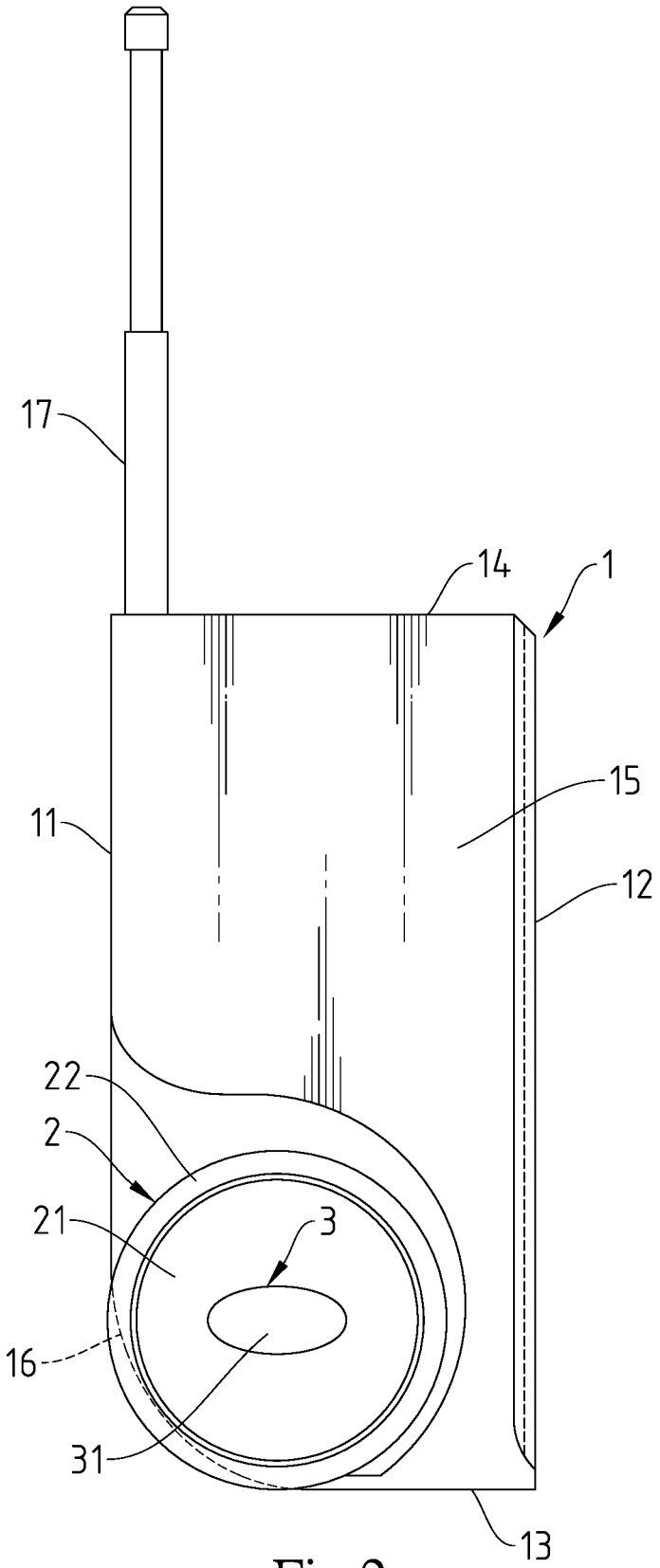
FIG. 2 is a schematic side view of the present invention, illustrating the transverse displacement wheel disposed in the inner side relative to the luggage body.

When the user receives the luggage, as illustrated in FIG. 2, unlock each locking device 3 and move the wheel holder 21 of each transverse displacement wheel 2 to a position near the front panel 12, and then uses the locking device 3 to lock the wheel holder 21 of the respective transverse displacement wheel 2 to the luggage body 1 in the position near the front panel 12. At this time, only a small part of the tire 22 of each transverse displacement wheel 2 protrudes over the giving-away surface 16 of the luggage body 1, and thus, the user can rest the bottom panel 13 on the floor. When the user wishes to drag the luggage, the user can tilt the retractable handle 17 and the luggage body 1, enabling the part of the tire 22 that protrudes over the giving-away surface 16 to be kept in contact with the floor.

Figure 3:
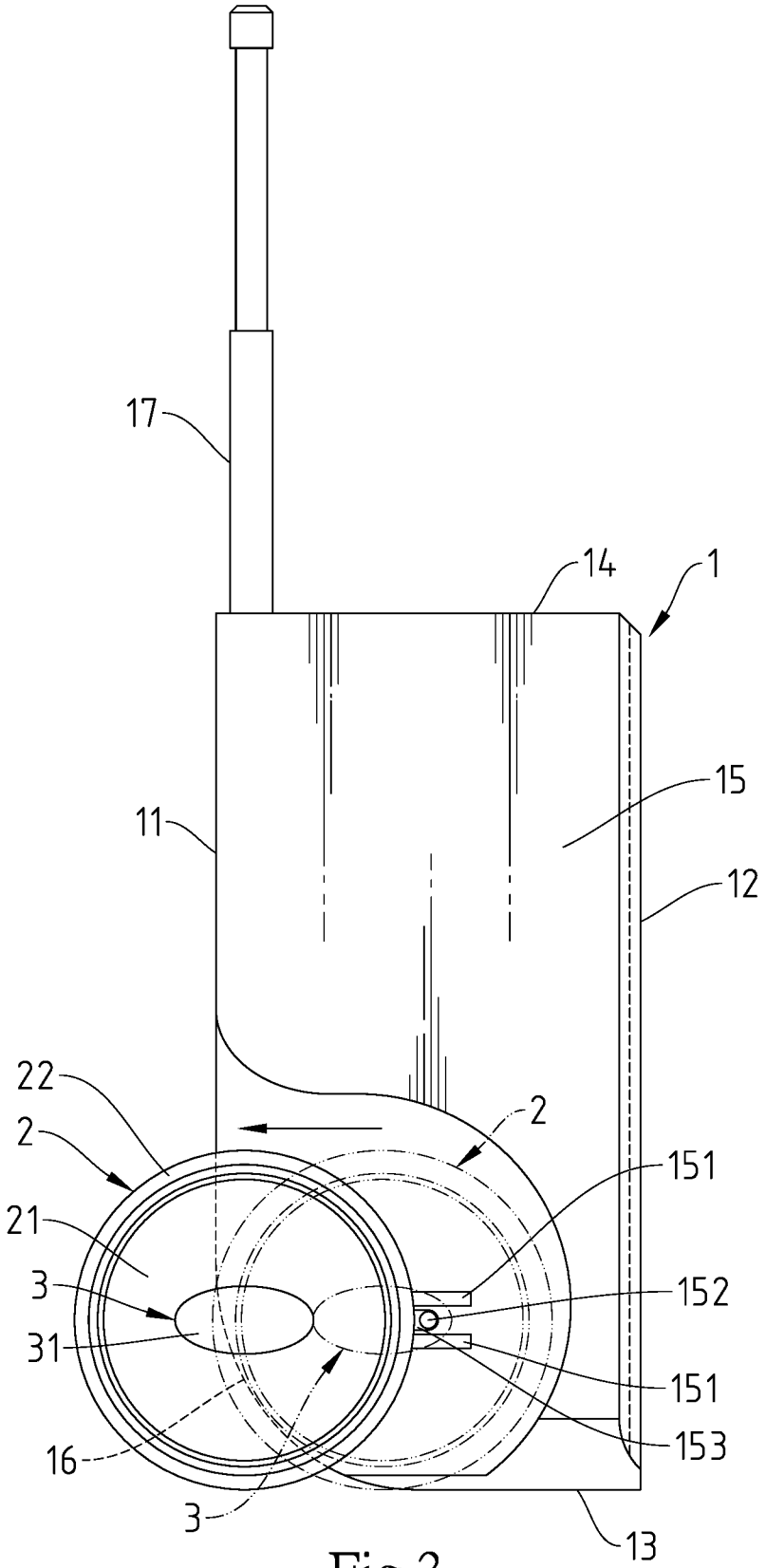
FIG. 3 is a schematic drawing of the present invention, illustrating the transverse displacement wheel moved toward the outer side relative to the luggage body.
Figure 4:
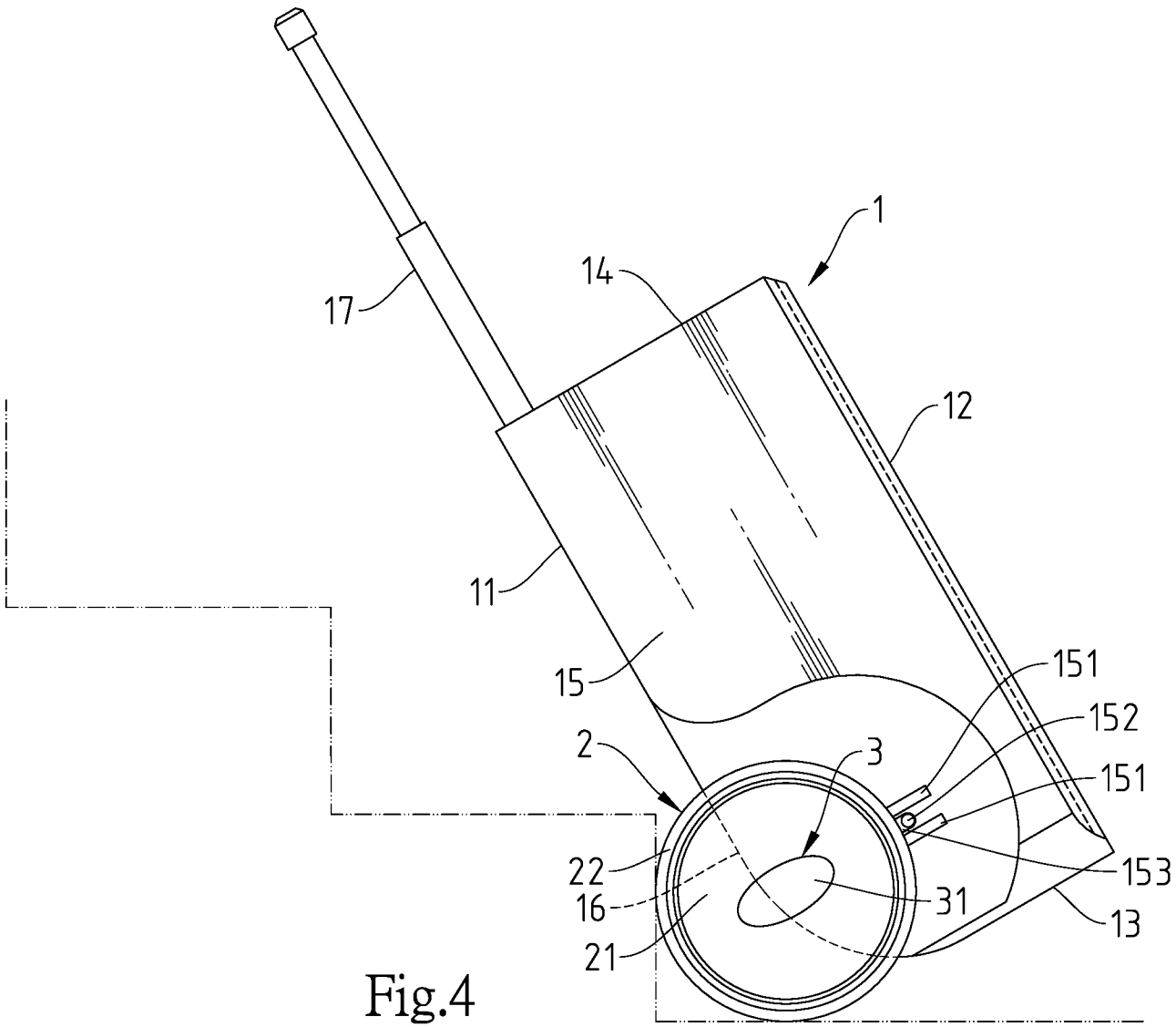
FIG. 4 is a schematic applied view of the present invention, illustrating the luggage moved on stairs.

When the user wants to walk the luggage on stairs or an uneven road surface, as shown in FIGS. 3 and 4, unlock each locking device 3 and turn the wheel holder 21 of each transverse displacement wheel 2 to a position far from the front panel 12, and then uses the locking device 3 to lock the wheel holder 21 of the respective transverse displacement wheel 2 to the luggage body 1 in the position far from the front panel 12. At this time, a relatively larger part of the tire 22 of each transverse displacement wheel 2 protrudes over the giving-away surface 16 of the luggage body 1. Further, when the wheel holder 21 is shifted from the first position to the second position far from the front panel 12, the fulcrum is also shifted outward, letting the luggage body 1 in the parking be not prone to dumping.

Referring to FIGS. 5-10, the luggage body 1 comprises a pair of transverse sliding grooves 151 located on each side panel 15 of the luggage body 1 and extended from the back panel 11 toward the front panel 12, a guide groove 153 located on each side panel 15 between the respective pair of transverse sliding grooves 151 in a parallel manner, and a plurality of positioning holes 152 located on each side panel 15 within the respective guide groove 153 and arranged in a line. The wheel holder 21 of each transverse displacement wheel 2 comprises a pair of sliding rails 211 located on one side thereof and slidably coupled to the pair of transverse sliding grooves 151 on one respective side panel 15, and a through hole 212 and a position-limiting hole 213 cut through two opposite sides thereof between the pair of sliding rails 211. Each locking device 3 comprises a positioning plate 31 attached to one side of the wheel holder 21 of one respective transverse displacement wheel 2 opposite to the sliding rails 211, a positioning post 32 perpendicularly extended from one side of the positioning plate 31 and inserted through the through hole 212 of the wheel holder 21 of the respective transverse displacement wheel 2 into one positioning hole 152 on the respective side panel 15.

Each locking device 3 further comprises a position-limiting post 33 perpendicularly extended from the same side of the positioning plate 31 and inserted into the position-limiting hole 213 of the wheel holder 21 of the respective transverse displacement wheel 2, a spring member 34 mounted on the position-limiting post 33 for imparting an elastic restoring energy to the positioning plate 31 when the positioning plate 31 is moved in direction away from the wheel holder 21 of the respective transverse displacement wheel 2, and a locating member 35 affixed to a distal end of the position-limiting post 33 with a fastening member 36 to stop the position-limiting post 33 from falling out of the position-limiting hole 213.

Figure 5:
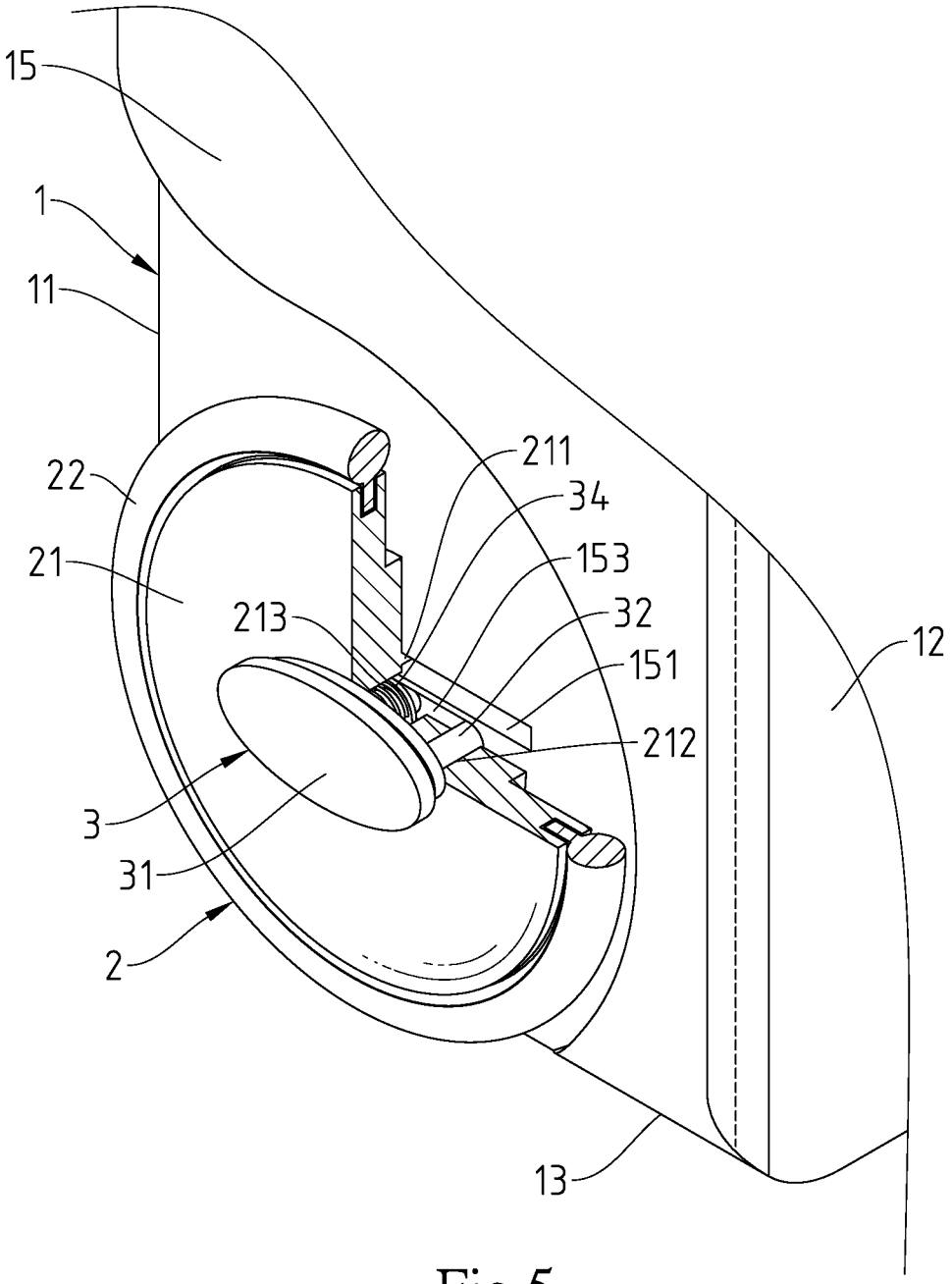
FIG. 5 is a sectional elevation of a part of the present invention, illustrating the transverse displacement wheel disposed in the inner side relative to the luggage body.
Figure 6:
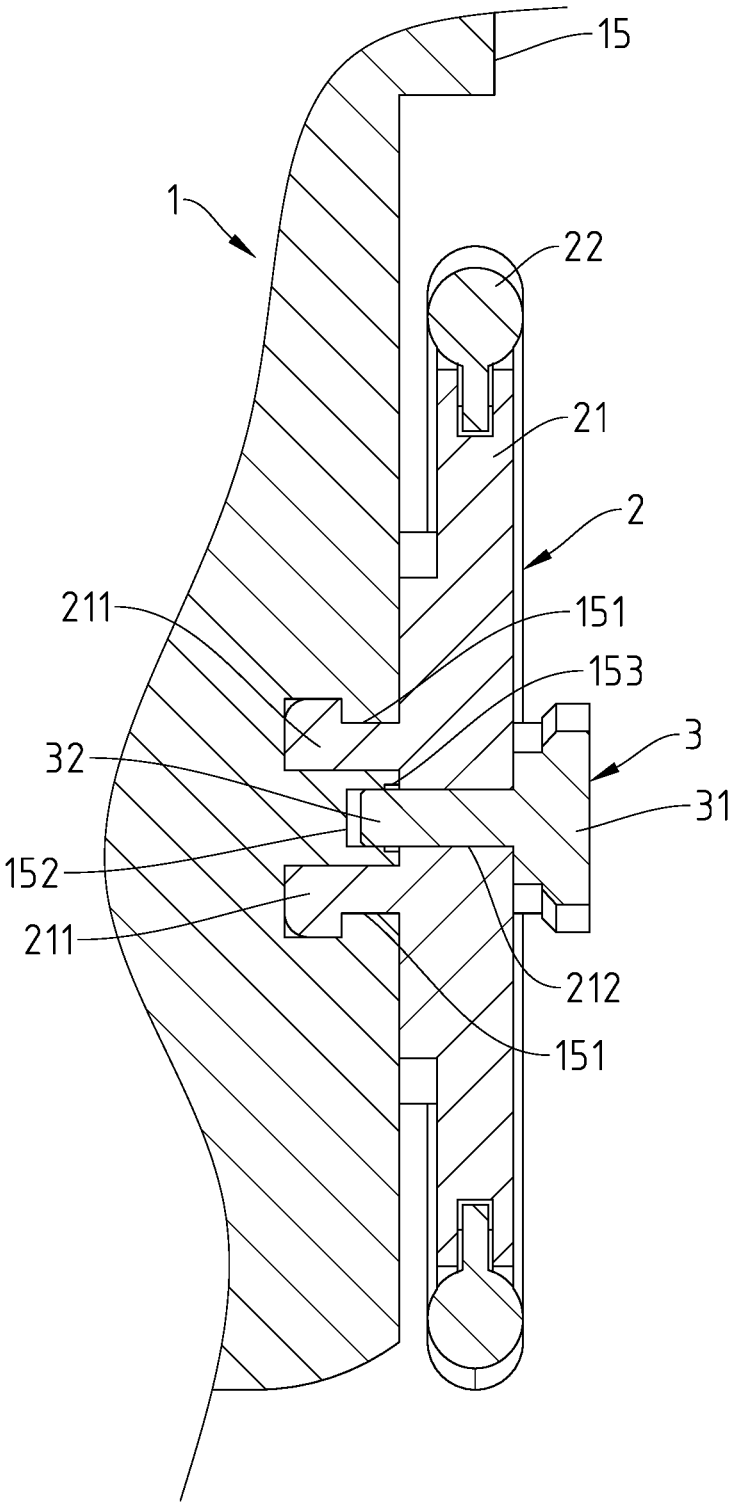
FIG. 6 is a schematic sectional view of the present invention, illustrating the transverse displacement wheel disposed in the inner side relative to the luggage body.
Figure 7:
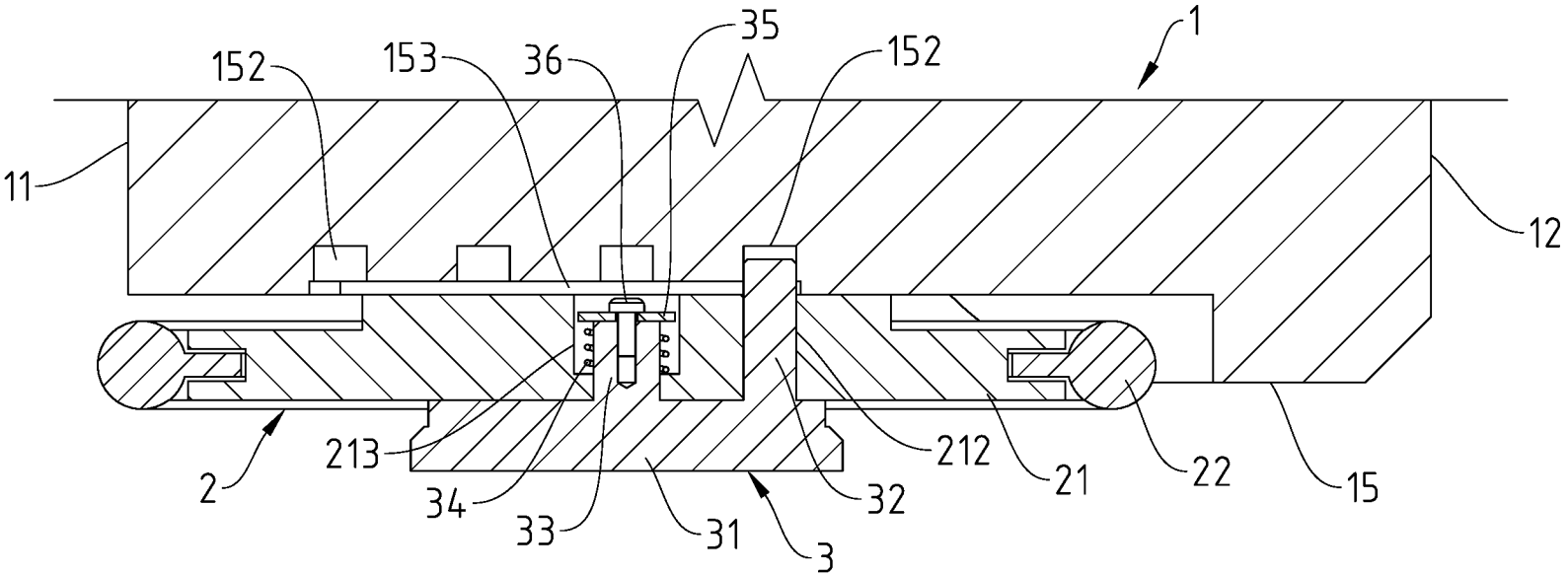
FIG. 7 is another schematic sectional view of the present invention, illustrating the transverse displacement wheel disposed in the inner side relative to the luggage body.
Figure 8:
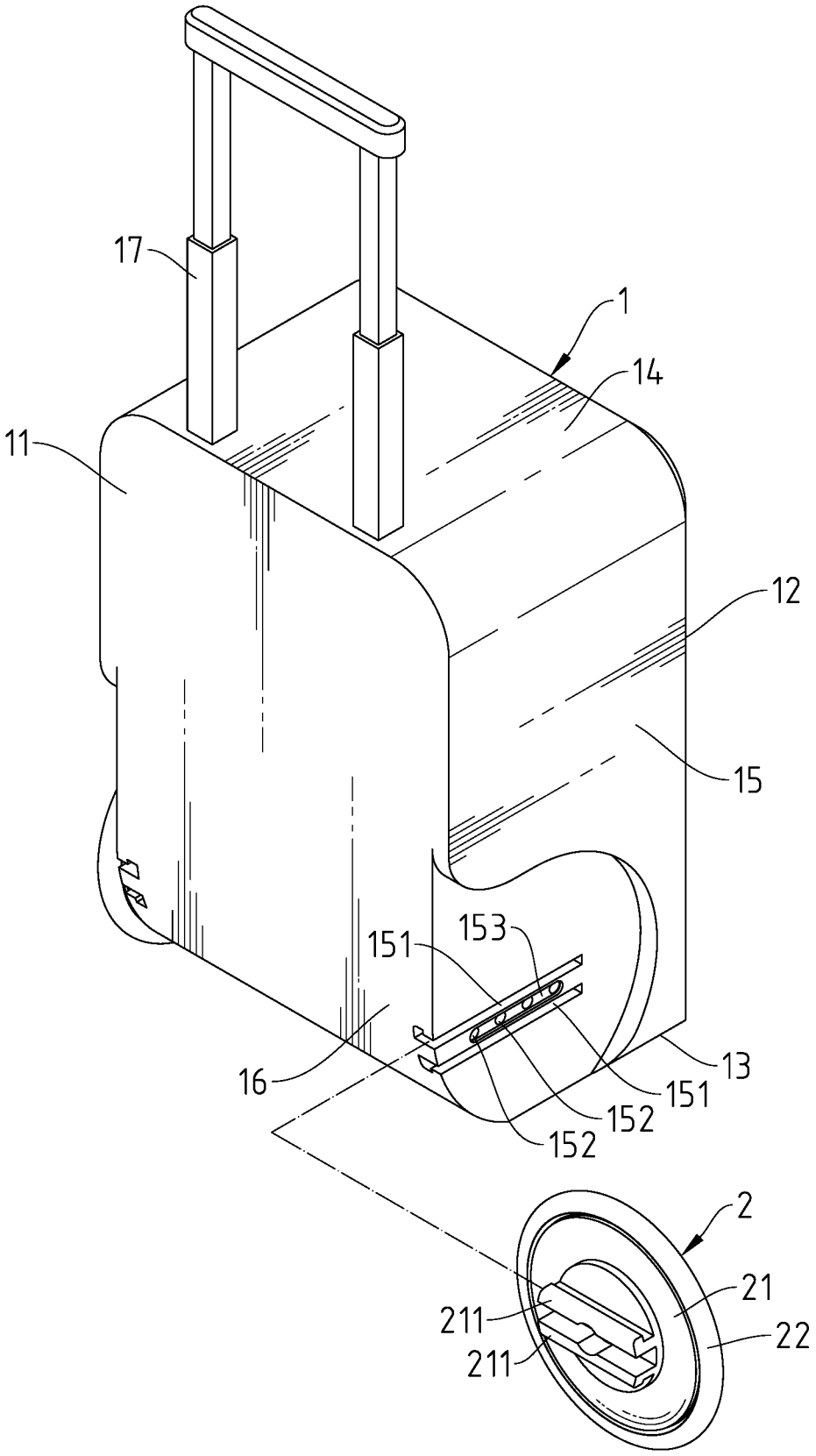
FIG. 8 is an exploded view of the transverse displacement wheel and the luggage body.
Figure 9:
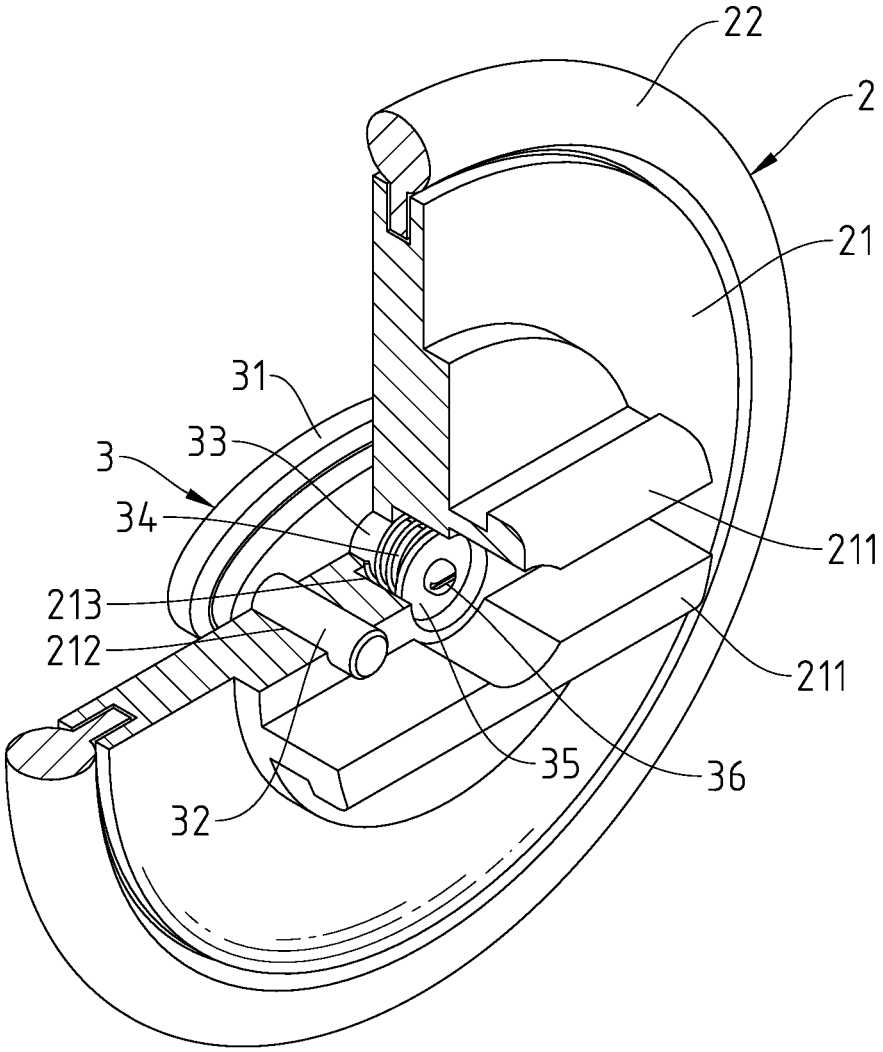
FIG. 9 is a sectional elevational view of the locking device and the transverse displacement wheel.
Figure 10:
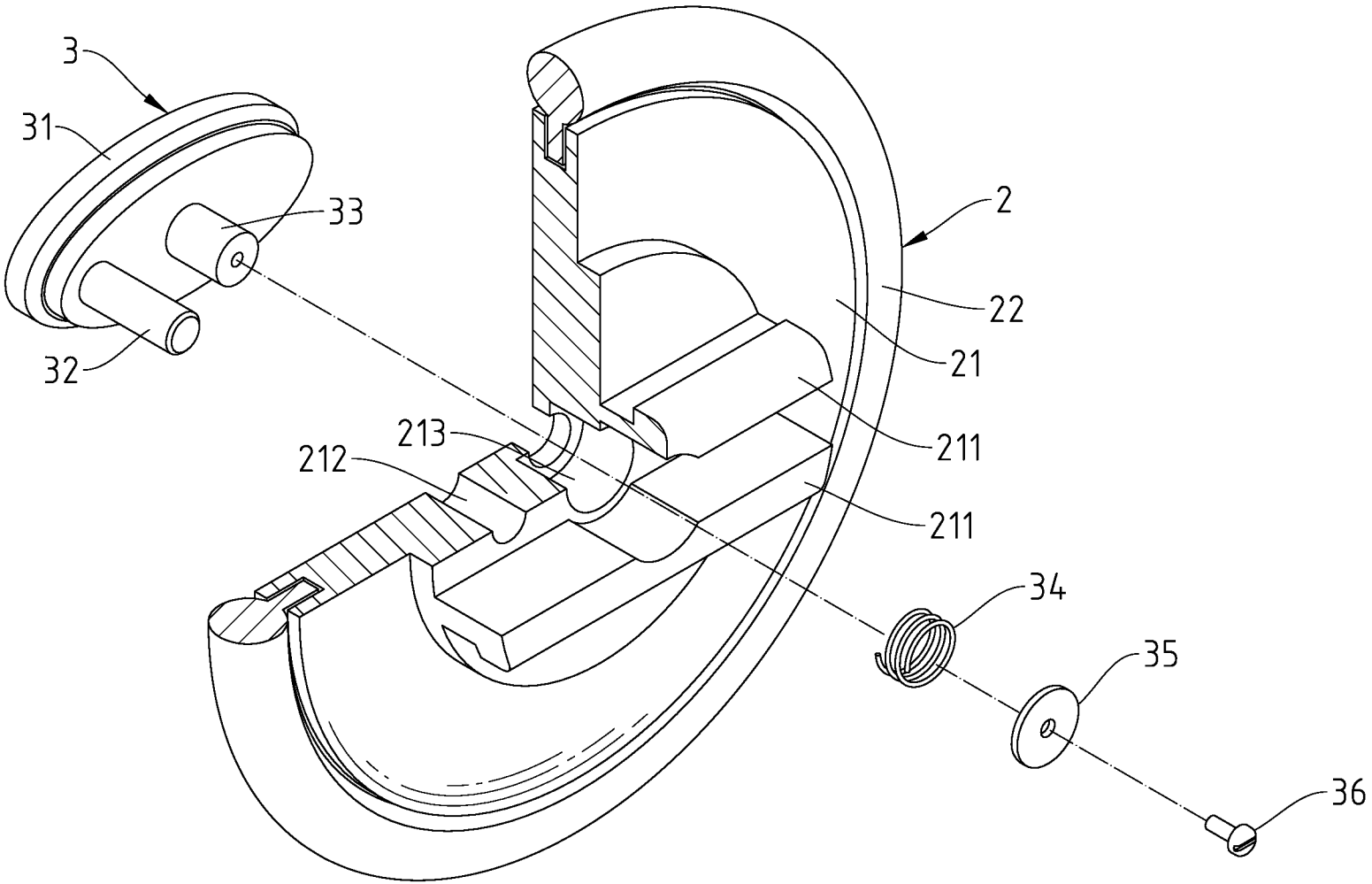
FIG. 10 is a sectional elevational exploded view of the locking device and the transverse displacement wheel.
Figure 11:
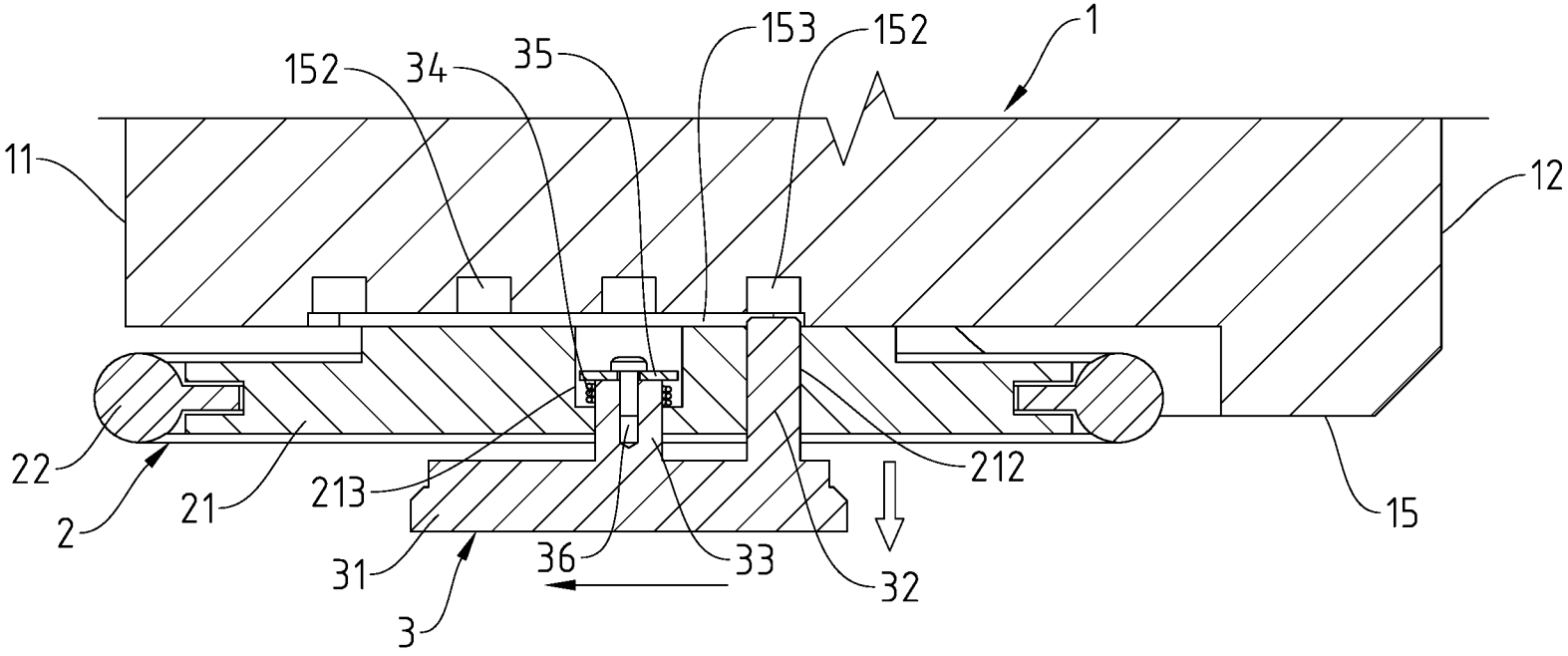
FIG. 11 is a schematic drawing illustrating the locking device unlocked the transverse displacement wheel.
Figure 12:
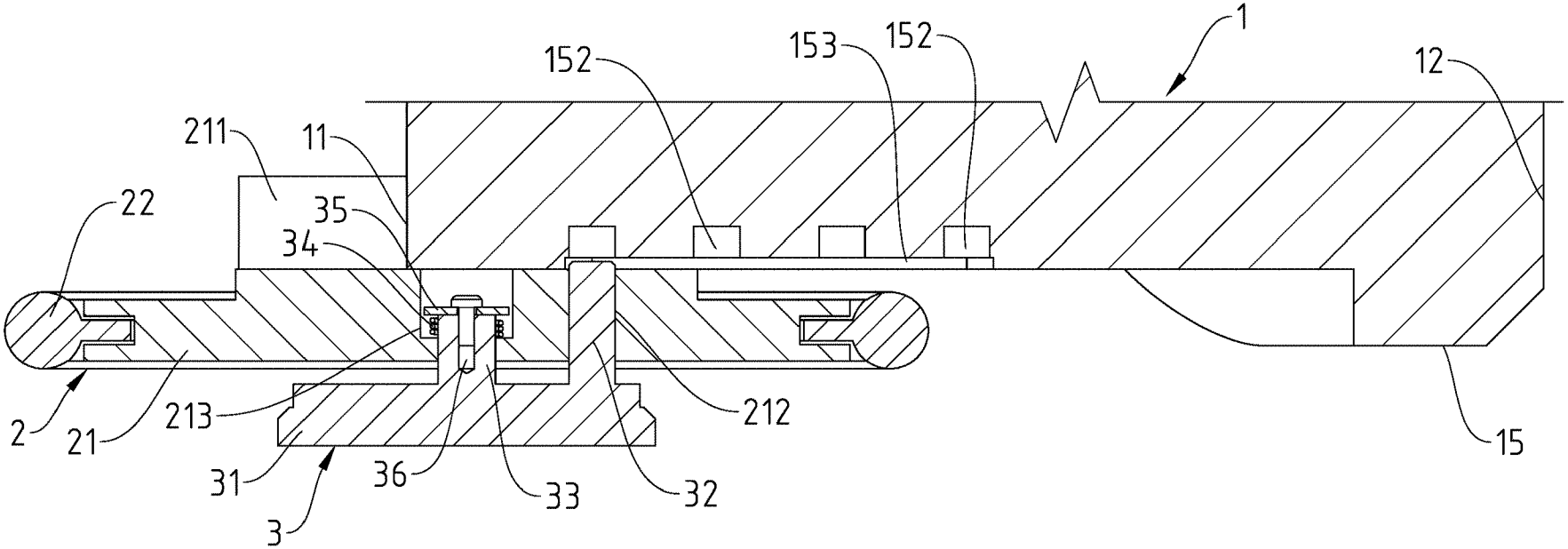
FIG. 12 corresponds FIG. 11, illustrating the transverse displacement wheel shifted to the second position.
Figure 13:
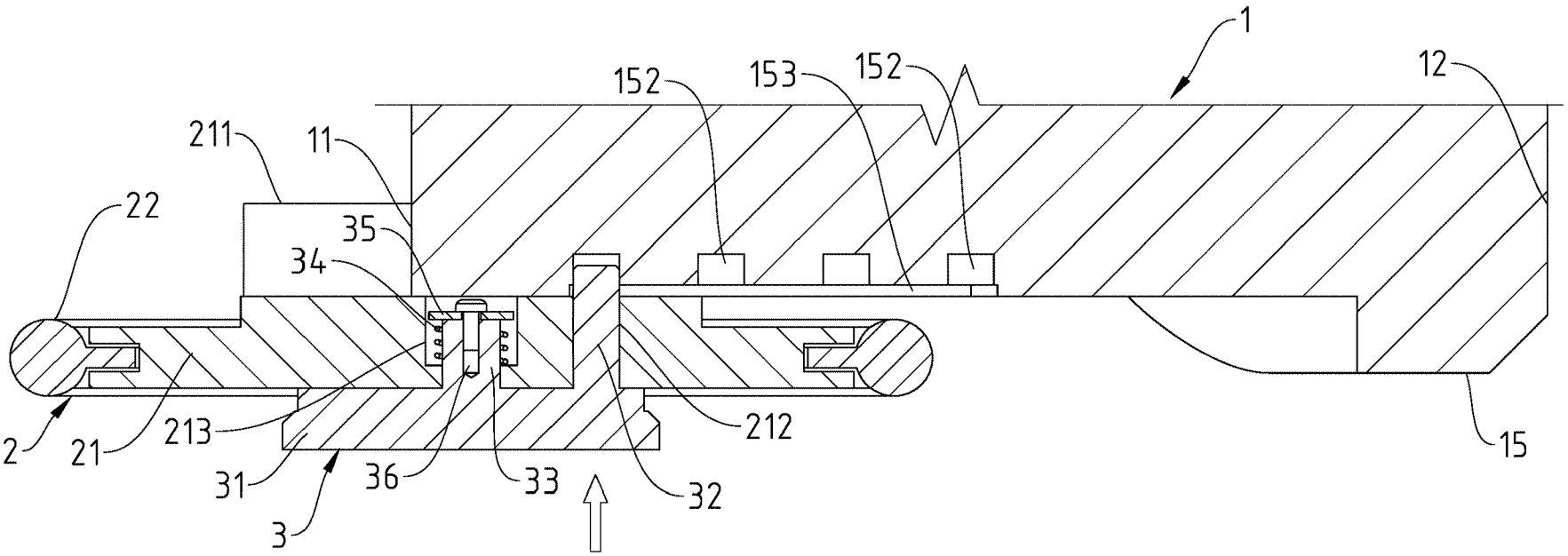
FIG. 13 is a schematic sectional view of the present invention, illustrating the transverse displacement wheel locked in the second position outside the luggage body.

As illustrated in FIGS. 5 and 7, when the wheel holder 21 is disposed near the front panel 12, the distal end of the positioning post 32 is positioned in the positioning hole 152 near the front panel 12. When wishing to shift the wheel holder 21 from the first position to the second position, as illustrated in FIGS. 11-13, pull the positioning plate 31 in direction away from the wheel holder 21 to disengage the distal end of the positioning post 32 from the positioning hole 152 near the front panel 12, and then move the wheel holder 21 along the respective transverse sliding grooves 151 in direction away from the front panel 12 to aim the positioning post 32 at the positioning hole 152 far from the front panel 12. As soon as the positioning post 32 is aimed at the positioning hole 152 far from the front panel 12, the positioning plate 31 is moved back and attached to the wheel holder 21, forcing the distal end of the positioning post 32 into the positioning hole 152 far from the front panel 12. Thus, the positioning post 32 can be selectively locked in one of the series of positioning hole 152 to lock the respective transverse displacement wheel 2 in one of a series of positions near or far from the front panel 12.

What is claimed is:

1. A luggage, comprising:

a luggage body comprising a back panel, a front panel, a bottom panel, a top panel and two opposing side panels respectively connected to one another, and a giving-away surface located on a junction between said bottom panel and said back panel and inwardly recessed toward an inside of said luggage body; and a transverse displacement wheel mounted to each said side panel of said luggage body, said transverse displacement wheel comprising a wheel holder and a wheel pivotally mounted on said wheel holder and peripherally protruding over said giving-away surface of said luggage body, said wheel holder being coupled to one respective said side panel near said giving-away surface and transversely slidable relative to said luggage body in a direction toward or away from said front panel and lockable to said luggage body in one of a series of positions;

wherein each said side panel of said luggage body comprises a pair of transverse sliding grooves transversely extended from said back panel toward said front panel, and a plurality of positioning holes arranged in a line between said pair of transverse sliding grooves; and said wheel holder of each said transverse displacement wheel comprises a pair of sliding rails located on one side thereof and slidably coupled to the pair of transverse sliding grooves on one respective said side panel and movable linearly toward or away from said front panel, and a locking device located on an opposite side thereof, said locking device comprising a positioning plate attached to one side of said wheel holder of the respective said transverse displacement wheel opposite to the associated said sliding rails, a positioning post perpendicularly extended from one side of said positioning plate and inserted through said wheel holder for positioning in one said positioning hole on the respective said side panel to lock respective said transverse displacement wheel to said luggage body.

2. The luggage as claimed in claim 1, wherein said wheel holder of each said transverse displacement wheel further comprises a through hole and a position-limiting hole cut through two opposite sides thereof between the said pair of sliding rails thereof; said positioning post of said locking device of each said transverse displacement wheel is inserted through said through hole of the said wheel holder of the respective said transverse displacement wheel into one said positioning hole on the respective said side panel; said locking device further comprises a position-limiting post perpendicularly extended from said positioning plate and inserted in said position-limiting hole, a spring member mounted on said position-limiting post for imparting an elastic restoring energy to the associating said positioning plate when said positioning plate is moved in direction away from the respective said wheel holder, and a locating member affixed to a distal end of said position-limiting post to prohibit said position-limiting post from falling out of the respective said position-limiting hole.

3. The luggage as claimed in claim 1, wherein each said side panel of said luggage body further comprises a guide groove disposed between the associating said pair of transverse sliding grooves in a parallel manner; the said positioning holes of each said side panel of said luggage body are located within said guide groove and arranged in a line.

* * * * *